United States Patent [19]

Erickson et al.

[11] 4,294,573

[45] Oct. 13, 1981

[54] SUBMERSIBLE ELECTRICALLY POWERED CENTRIFUGAL AND JET PUMP ASSEMBLY

[75] Inventors: John W. Erickson, Huntington Beach; Harold L. Petrie, Sierra Madre, both of Calif.

[73] Assignee: Kobe, Inc., Huntington Park, Calif.

[21] Appl. No.: 39,775

[22] Filed: May 17, 1979

[51] Int. Cl.[3] ..... F04B 23/14

[52] U.S. Cl. ..... 417/83; 415/168; 417/89; 417/160; 417/424

[58] Field of Search ..... 417/76, 78–84, 417/89, 160, 244, 245, 424, 423; 415/168, 199.1, 121 R, 121 A, 121 G; 60/39.09 P

[56] References Cited

U.S. PATENT DOCUMENTS

| | | | |
|---|---|---|---|
| 2,297,185 | 9/1942 | Hollander et al. | 417/81 |
| 2,603,157 | 7/1952 | Conery | 417/81 |
| 2,845,028 | 7/1958 | Nash et al. | 417/81 |
| 2,853,013 | 9/1958 | Lung | 417/81 X |
| 3,362,155 | 1/1968 | Driscoll | 415/168 X |
| 3,736,072 | 5/1973 | Turner et al. | 417/79 |

*Primary Examiner*—Carlton R. Croyle
*Assistant Examiner*—Edward Look
*Attorney, Agent, or Firm*—Christie, Parker & Hale

[57] ABSTRACT

A petroleum well has a plurality of centrifugal pump stages, a jet pump stage, and an electrical drive motor. A recirculated portion of the output from high pressure stages of the centrifugal pump provides power fluid for the jet pump, and the jet pump aspirates fluid from lower pressure centrifugal pump stages. The balance of the output of the high pressure stages goes to the surface as production. The output of the jet pump supplies the high pressure stages. A centrifugal cleaner upstream of the power fluid inlet for the jet pump cleans that stream of particulates. The overall flow rate through the centrifugal stages exceeds the production rate of the pump by the amount of power fluid for the jet pump. The jet pump caps the assembly and can be separately removed for servicing and adapting the pump to the flow requirements of the well.

19 Claims, 4 Drawing Figures

SUBMERSIBLE ELECTRICALLY POWERED CENTRIFUGAL AND JET PUMP ASSEMBLY

BACKGROUND OF THE INVENTION

The present invention relates in general to pumps finding particular efficacious use in petroleum wells, and, more in particular, to such pumps that are electrically operated and have centrifugal stages.

Submersible petroleum pumps have been in use for some time. These pumps reside downhole in a petroleum well in the vicinity of the petroleum bearing formation. Typically, the pumps force petroleum from the formation to the surface of the well. Other applications of such pumps include their use in formation flooding for secondary recovery of petroleum.

Centrifugal pumps are pumps driven in rotation. An impeller of the pump rotates within a casing. Fluid enters the pump at an eye of the impeller. Vanes of the impeller impart energy from the prime mover, here an electric motor, to the fluid flowing through the impeller in channels between the vanes. Conventionally, the energy content of the fluid is expressed as head and has the units of force times length divided by mass. Centrifugal pumps are chracterized by imparting a significant radial component to the fluid they pump. Axial flow pumps, by contrast, do not impart a significant radial component to fluid passing through them. Centrifugal pumps are also characterized by low flow rates and high head increase. Axial flow pumps are characterized by low head increase and high flow rates.

The specific speed of a pump relates three performance parameters of the pump as follows:

$$N_s = N(Q)^{\frac{1}{2}}/(H)^{\frac{3}{4}}$$

where:

$N_s$=specific speed

N=rotational speed of the pump (1/t)

Q=flow rate through the pump ($l^3/t$)

H=head ($l^2/t^2$)

t=time (e.g., seconds)

l=length (e.g., meters)

A characteristic specific speed for optimum efficiency exists for each type of pump. For a centrifugal pump, the specific speed at optimum efficiency is low with respect to the specific speed of an axial flow pump. Centrifugal pumps develop considerable head. On the other hand, their flow passages are small. With the small passages, friction losses become serious at high flow rates. Accordingly, flow rates are comparatively low for efficient centrifugal pumps.

Many petroleum wells produce only a small quantity of petroleum. By way of example, some petroleum wells produce only 100 to 200 barrels of petroleum per day. For electric motor-driven centrifugal pumps used in downhole locations, this flow rate results in specific speeds that are far below optimum. The motor speed being constant, the only variable that can be adjusted is head to maintain adequate specific speeds. But dropping the head requires a reduction in the diameter of the impeller, which is undesirable, and an increase in the number of required stages, which is also undesirable. Diameter reduction reduces the startup head capacity available and eliminates standardization of pump stage units.

Downhole centrifugal pumps cannot practically be made axially short to restrict channel capacity to match low flow rates. The spacing between the pump's impeller and casing must reduce as the size of the pumps drops. The required spacing in small pumps is too difficult to meet on a production basis. Furthermore, resultant vane length attending a design with low flow rates becomes too long, and friction losses increase as a result. Very significant percentage increases in disc friction or windage with respect to power befalls too great a centrifugal stage size reduction. Circulation loss between the discharge and inlet also increases and is a factor.

These factors result in the impracticality of very low flow rates in centrifugal pumps.

Centrifugal pumps operate efficiently and reliably when the flow rate of the pumps is on the order of 600 barrels per day. When the petroleum well flows on the order of 150 barrels per day, efficient and reliable operation of the submersible electrically powered centrifugal pumps becomes impossible.

Unless such pumps operate within their design range, a substantial risk of motor failure exists. Motor failure not only shuts down a well, but requires considerable time and effort to remedy. The requirement of pulling a pump from a well hundreds or thousands of feet deep illustrates this. With the pump operating at low efficiency, a risk that no pumping at all will occur exists. When this happens and no fluid passes through the pump, motor failure from heating can occur.

Even with overload detectors it is not possible to always sense in time a condition where motor failure can occur. While operating at very low flows a slight rise in head results in a dramatic drop in flow. During this time the amount of the energy expended by the motor remains very nearly the same. Accordingly, motor cooling suffers. Moreover, the pump can be in a very deep well and the time lag between sensing a dangerous condition at the surface and turning off the motor may be too long to save the motor.

SUMMARY OF THE INVENTION

The present invention provides a submersible electrically powered centrifugal and jet pump assembly adapted for use downhole in a petroleum well that enables centrifugal pump stages of the assembly to recirculate much of the pumped well fluid while preserving significant head and accepting a well dictated overall production rate considerably lower than the flow rate required for optimum and efficient centrifugal pump stage operation.

More specifically, the present invention provides a series of centrifugal pump stages powered by an electrical motor. Both the pump stages and the motor are adapted for downhole residence. The jet pump is powered by high pressure fluid from a high pressure stage of the centrifugal stages and aspirates lower head production fluid of the centrifugal stages. The putput of the jet pump feeds both the power and aspirated fluid to the high pressure stages of the pump assembly. The centrifugal stages, motor and jet pump may be in a housing formed, say, from tubing sections. Discharge to the surface takes off from the outlet of the high pressure stages. The jet pump preserves some of the fluid energy imparted to the fluid by the high pressure stages of the centrifugal pumps to do useful work in pushing the fluid to the surface, and at least most of the centrifugal stages see a fluid flow rate consistent with their design flow rate.

Stated differently, the present invention contemplates in a centrifugal and jet pump assembly low pressure centrifugal stages powered by an electrical motor. The discharge of these stages provides the aspirated fluid for the jet pump. The power fluid for the jet pump comes from high pressure centrifugal stages as a recirculation stream from these stages. Production fluid goes to the surface from the high pressure stages. This approach assures sufficient inlet head to the jet pump to avoid cavitation problems.

Preferably, the jet pump caps a stack of the centrifugal pump stages and is readily removable from the balance of the assembly so that the size of the jet pump can be tailored to the flow conditions existing at the site without pulling the entire pump assembly. Furthermore, jet pump maintenance and renewal can be accommodated by this placement. The jet pump can rest on the uppermost of the centrifugal pump stages and have a latch that engages an appropriate shoulder of the casing in which the jet pump resides. A tool can trip the latch and permit pump removal. It is also preferred to centrifugally cleanse the power fluid of particulates before it enters the jet pump to avoid erosion. One or more booster stages can increase the head of power fluid from the cleaner before entry into the jet pump.

These and other features, aspects, and advantages of the present invention will become more apparent from the following description, appended claims, and drawings.

DESCRIPTION OF THE PREFERRED EMBODIMENT

Figure 1:
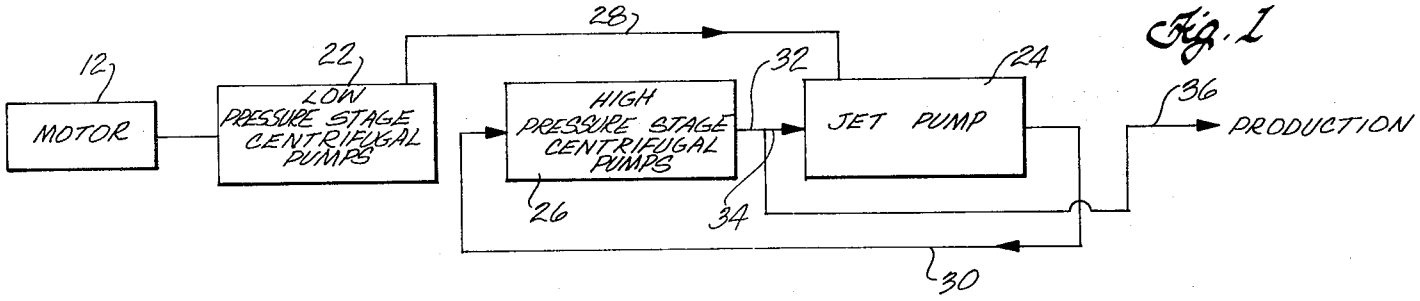
FIG. 1 illustrates very schematically the overall organization of the submersible, downhole, electrically powered, centrifugal and jet pump assembly of the present invention.
Figure 3:
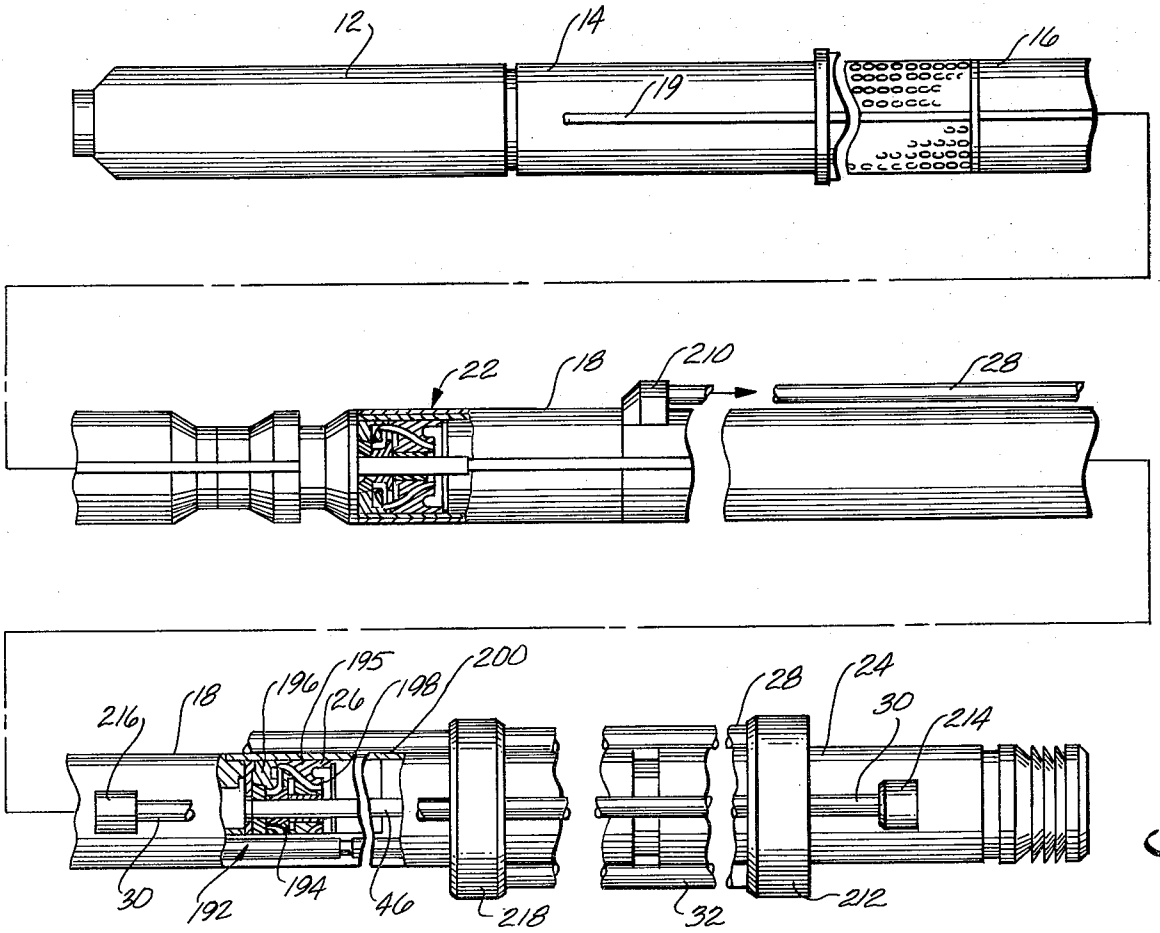
FIG. 3 illustrates a preferred embodiment of the centrifugal and jet pump assembly of the present invention somewhat schematically, somewhat broken away, and in partial half section. For purposes of illustration the pump has been broken into parallel sections from the coaxial alignment the sections actually take.

Initially, reference should be had to FIGS. 1 and 3. Those Figures show the preferred form of the downhole centrifugal and jet pump assembly of the present invention.

The pump includes elements that are known as such in the prior art and will not be described in detail because of this fact. The organization includes an electric motor section 12, a seal section 14, a gas separator section 16, and, finally, a pump section 18. These sections progress in the order presented from bottom to top.

The motor section includes an electrical motor energized by current drawn from the surface as through a conduit 19. The seal section integrates with the motor. It consists of mechanical seals separated by pressure compensated oil storage chambers. The seals act in series with the chamber between them. In the event of failure of the formation side seal, the oil chamber will have to fill before any possibility of leakage past the backup seal. The seal section is pressure compensated so that the pressure in the section is about equal to submerged pressure.

The gas separator separates gas from liquid by a centrifugal force field. Gas is diverted into an annulus and the liquid forced at a positive head into a first stage of the pump.

The entire unit resides downhole in a petroleum well. It is used to pump production values from a formation to the surface. The head of the production fluid is increased by centrifugal pump stages in the pump section. These centrifugal pump stages may consist of several hundred individual units. A first plurality of such pump stages is indicated by reference numeral 22. These stages are low pressure. In the present invention, a jet pump section 24 receives for aspiration the output of the low pressure centrifugal pump stages and the jet pump supplies the input to high pressure centrifugal pump stages. The high pressure centrifugal pump stages are shown by reference numeral 26. The serial coupling just described is shown in FIG. 1 diagrammatically. A discharge line 28 from the low pressure centrifugal pump stages provides the aspirated fluid for the jet pump. A discharge line 30 from the jet pump provides the input to high pressure centrifugal pump stages 26. The output of the jet pump includes both the aspirated and power fluids. The output of the high pressure centrifugal pump stages flows through a discharge line 32. This discharge line branches to provide the power fluid for the jet pump and the production fluid stream. In FIG. 1, these branches are shown by reference numerals 34 and 36, respectively.

As brought out in the Background of the Invention section of this specification, centrifugal pumps are size-limited. One cannot make a centrifugal pump very small and expect reasonable performance. Briefly, the problems attending size reduction of centrifugal pumps include disc friction loss, impeller casing dimensions that are too hard to hold, runner friction loss, and leakage loss.

Figure 2:
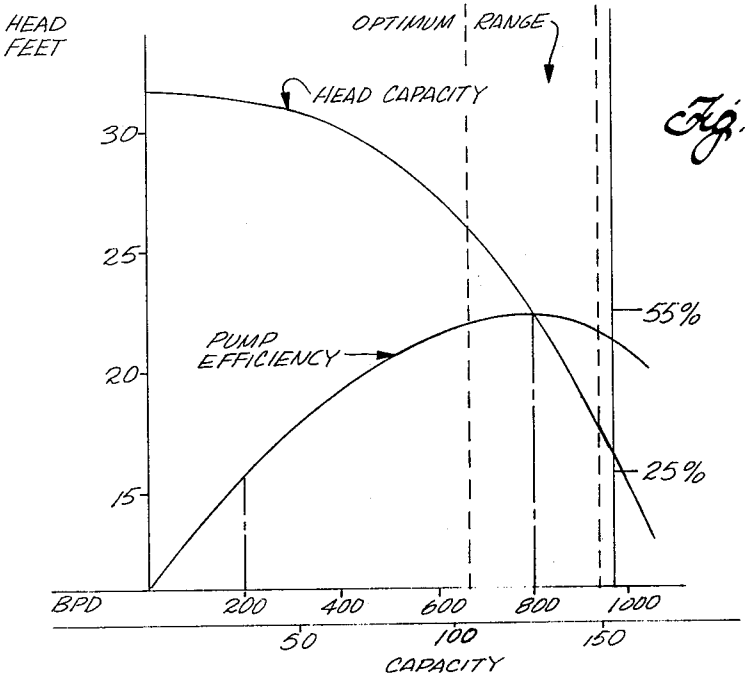
FIG. 2 illustrates performance characteristics of a single stage centrifugal pump.

Many petroleum wells have a daily output considerably below the minimum output at which centrifugal pumps run efficiently and reliably. The minimum level of efficient operation of a centrifugal pump may be about 650 barrels per day, as seen in FIG. 2. That Figure illustrates performance for a single stage. When a well produces considerably lower quantities of production fluid, the pump efficiency drops dramatically. By way of example and with reference to FIG. 2, a well producing only 200 barrels per day operates at an efficiency of about 25%. The same pump installed in an 800 barrel-per-day well operates at about 55% efficiency. The difficulty in running at low efficiency includes the possibility of motor failure through lack of cooling. As already pointed out, the motor is in formation fluid at the bottom of a column. In the event that the head of the well fluid in a well increases slightly, the possibility of motor burn-out exists. Low efficiencies correspond to a flat part of the head capacity curve. With a slight rise in head the flow rate drops and the motor does not cool as well. With a slight drop in well fluid level in the well it is also possible that the pump would not be able to maintain its prime and the pump could burn out because of this.

A second problem attends downhole pumps and that problem is the requirements of a fairly substantial startup head. The head available in low capacity centrifugal pumps may not be up to the task required of the pump system.

The present invention provides a manner of improving the operational range of a downhole centrifugal pump system by augmenting the system with a jet pump that captures some of the energy imparted to a production fluid stream by the centrifugal pump stages while permitting the pumps to operate at a capacity within their optimum range. Very briefly, the jet pump conserves a considerable amount of the energy imparted to the fluid from lower pressure stages of the centrifugal pump and recirculates fluid through a high pressure centrifugal pump stage. The jet pump's position at the top of the stack permits its easy removal and adjustment for the particular well conditions obtaining.

Figure 4:
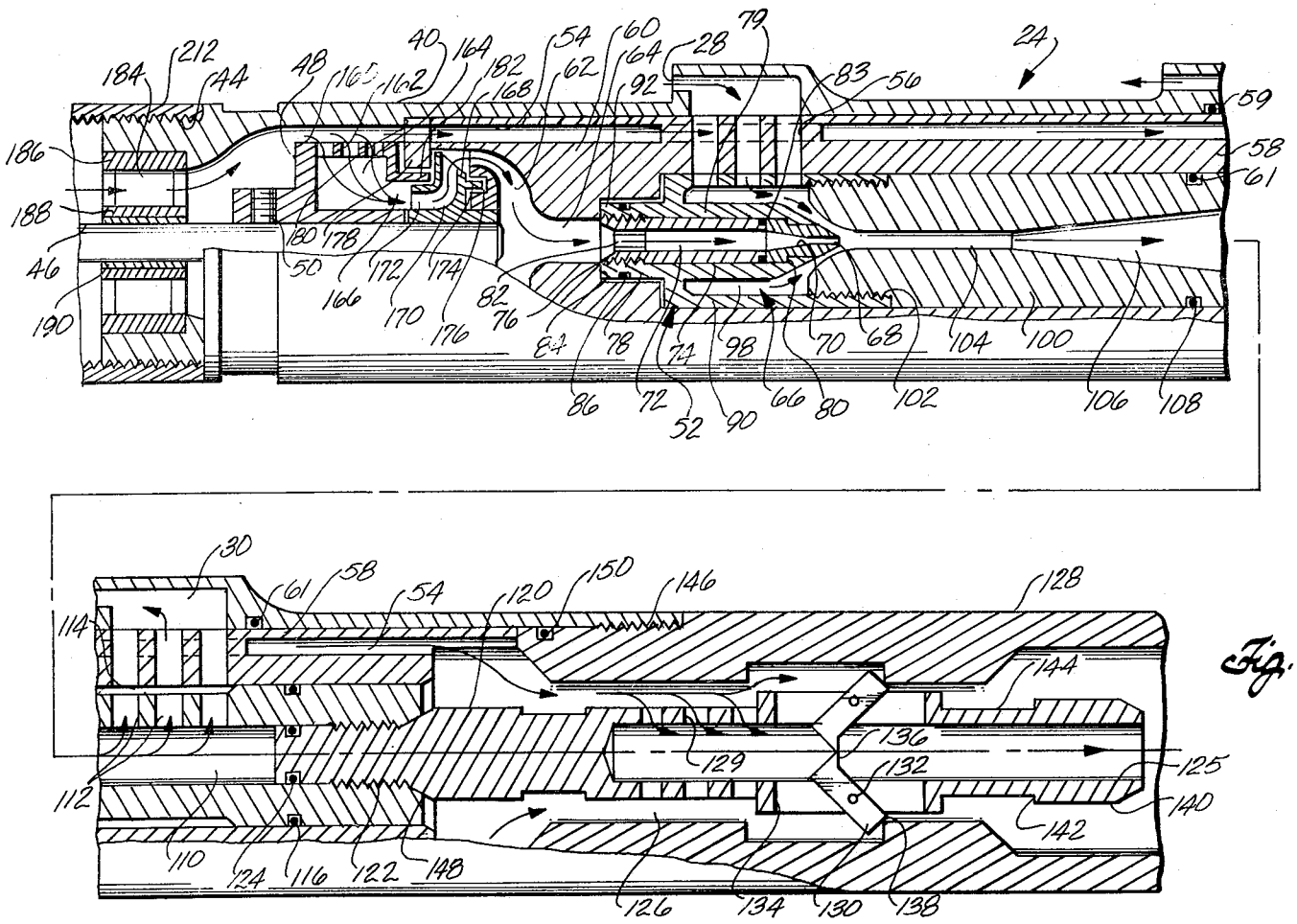
FIG. 4 illustrates in detail the jet pump section of the present invention.

With reference to FIG. 4, jet pump assembly 24 is illustrated. A tubing section 40 couples by threads 44 to a second tubing section 42. Tubing section 42 passes the discharge of the high pressure centrifugal pump stages 26 into jet pump assembly 24. A power shaft 46, extending coaxial within tubing 40, is driven by the electric motor. A centrifugal cleaner 48 attaches to shaft 46, as by a set screw 50, and eliminates particulates from the fluid stream entering the jet pump. A jet pump 52 receives the clean effluent discharge from the cleaner. Dirty effluent from the cleaner and production fluid passes through longitudinal passages 54 located at about the outer radial limit of jet pump assembly 24. Line 28 discharges into the jet pump assembly as through a plurality of radial passages 56 in a containing sleeve 58. Sleeve 58 has longitudinal passage 54 drilled through it. In practice radial passages 56 and longitudinal passages 54 are annularly offset and passage 54 does not step around passages 56. The sleeve resides concentrically within outer tubing section 40. The sleeve receives and locates the jet pump assembly. That assembly can be pulled from the sleeve. The interface between the sleeve and tubing section 40 is sealed by O-ring seals 59.

A seating section 60 of sleeve 58 at the upstream end of the jet pump assembly axially locates and seats the jet pump assembly. Sleeve 58 and jet pump 52 cooperate to permit the pump to be drawn out of the sleeve and forced back into the sleeve against seating section 60. The interface between the two is sealed by O-Ring seals 61. Seating section 60 has a plurality of radially converging passages 62 that receive the discharge from cleaner 48. These passages converge on the axis of the pump and merge into a central passage 64. The discharge of the cleaner provides the power fluid of the jet pump. The discharge from the low pressure centrifugal pump stages provides the aspirated fluid for the jet pump.

A nozzle assembly 66 seats in seating section 60. The assembly includes a nozzle tip 68 that defines a converging nozzle passage 70. Upstream of nozzle passage 70, is an axially right cylindrical passage 72. Cylindrical passage 72 is defined within a locator cylinder 74. A setting nut 76 threads into threads within a nozzle mounting body 78. Nozzle tip 68 has an external flange 80 that engages an interior shoulder of body 78 to axially locate the nozzle tip. The locator cylinder abuts the posterior end of nozzle tip 68. Setting nut 76 abuts the posterior end of the locator cylinder. A mounting sleeve 79 of the nozzle mounting body receives and locates the nozzle tip, locator cylinder, and setting nut. Interior hexagonal wrenching flats 82 within the nut permit the tightening of the nut and the assembly of the nozzle tip and cylinder within mounting body 78. An O-ring 83 provides a seal at the interface between the nozzle mounting body and the locator cylinder.

The nozzle mounting body itself seats within seating section 60 against a shoulder 84 of that body. An O-ring 86 effects a seal between the nozzle mounting body and seating section 60 of sleeve 58.

The nozzle mounting body continues with a cylindrical section 90 that steps out radially from a reduced diameter section 92. It is in this reduced diameter section that O-ring 86 is housed. Cylindrical section 90 and nozzle mounting sleeve 79 define an annulus 98 for receipt of aspirated fluid. The annulus necks down radially to meet the outlet of nozzle 70 along the axis of the jet pump. A mixer throat and diffuser body 100 within sleeve 58 connects to nozle mounting body 78 through threads 102. Mixer throat and diffuser body 100 defines a mixer throat 104 that receives the discharge of nozzle 70 and aspirated fluid from passage 98. A difuser 106 opens from the end of mixing throat 104 for the recovery of static head. An O-ring seal 108 between the mixer throat and diffuser body 100 and sleeve 58 seals the interface between the two. Diffuser 106, in turn, opens into a right cylindrical passage 110 that, in turn, opens through radial passages 112 into jet jump discharge line 30. Radial passages 112 extend through the wall of mixer throat and diffuser body 100 and through registered continuations in sleeve 58. An annular channel 114 on the outer surface of mixer throat and diffuser body 100 can serve to assure communication of the two sections of the radial passages. An O-ring seal 116 between the mixer throat and diffuser body and sleeve serves to seal that interface at the upper end of the jet pump assembly.

A pulling tool 120 threads into the head end of mixer throat and diffuser body 100 and extends coaxially with respect to the body away therefrom at the top of the jet pump section. The pulling tool includes a stud end 122 that provides the threaded coupling to the mixer throat and diffuser body for the pulling tool. This stud end has an O-ring 124 to seal off passage 110. A central passage 125 within the pulling tool receives production fluid from passage 54. This communication is effected in part through an annulus 126 between the tool and a tubing section 128. A plurality of radial passages 129 from this annulus completes the communication between central passage 125 and passage 54. A pair of "Z-latches" 130 pivotally mount through pins 132 in recesses 134 in the pulling tool. Each of these Z-latches has a flared inner end 136 to provide bearing for an extracting tool that extends into passage 125 to engage the latches and rotate them in a direction tending to align their lengths with the axis of the tool. The latches may be spring-biased into a locked position. In a locked position, the position shown in FIG. 4, ends of the latches bear on an interior shoulder 138 within tubing section 128. A head 140 of the pulling tool has a shoulder 142 that steps from the head down to a neck 144. An extracting tool snaps over the head and in behind the shoulder, and a nose of the unlocking tool trips the latches after which the asembly can be pulled to the surface. A conical shoulder 148 of the tool seats on a conical seat of mixer throat and diffuser body 100 to locate the latches with respect to shoulder 138.

Threads 146 at the upper end of tubing section 40 provide for the attachment of the section to tubing section 128. An O-ring seal 150 between the two tubing sections seals their interface.

Cleaner 48 includes a barrel 160. Barrel 160 has an annular, axially extending wall 162 perforated through to a chamber 164. Rotation of the barrel establishes a centrifugal field that prevents particulate matter from entering the chamber. As such, particulate matter is cleaned from the fluid entering the chamber. Cleansed fluid passes through an annular passage 166 at the radial inside of the chamber and into a centrifugal pump stage 168. This pump stage increases the head of the cleaner discharge slightly prior to its entry as power fluid into the jet pump. The centrifugal pump stage 168 includes an impeller 170 that has impeller channels 172 that turn from axial to radial. The impeller also includes a lip 174 that revolves within an annular groove 176 within seating section 60 of sleeve 58. This relationship provides a seal. Seating section 60 walls the discharge of the impeller and serves as the casing for this pump stage. A ring seal 178 axially between sleeve 58 and an interior shoulder 180 of outer tubing section 49 provides a radial wall for one side of the casing for the impeller and and annular channel for an axially extending lip 182 of cleaner 48. Lip 182 extends into this channel and over the hub of the impeller to effect a seal between the lip and the impeller and between the lip and the ring.

Upstream of the cleaner, the outer tube contains stators 184 disposed between two concentric stator rings 186 and 188 and secured within outer tubing section 40. A bushing 190 between shaft 46 and the inner of these stator rings serves as a bearing for the shaft.

Low pressure centrifugal pump stages 22 include a plurality of centrifugal stages comprised of impellers and stators arrayed along shaft 46. A similar impeller and stator arrangement defines the high pressure centrifugal pump stage 26. The description of one stage serves to define them all. With reference to high pressure stage 26, an intrastage centrifugal pump and impeller 192 has an impeller 194 staked to shaft 46. A casing 195 receives the impeller and defines outlet passages from the impeller to the next stage. The casing is split midway along its length into entrance and exit sections 196 and 198. Both sections are received within a sleeve 200. The number of stages can be changed at will at the surface.

Manifolding for the system is straightforward. As previously related, the output of the first low pressure pump stages provides the aspirating fluid for jet pump 24. Output line 28 from the low pressure stages receives the discharge from the low pressure stages through a coupling fitting 210. An input coupling ring 212 of the jet pump receives the discharge. The output of the jet pump feeds the second high pressure centrifugal pump stages through production line 30. Line 30 emanates at a fitting 214 and completes at a fitting 216. A coupler 218 receives the output of the high pressure pump stages and feeds line 32. Line 32 discharges into coupler 212, which in turn feeds centrifugal cleaner 48 and jet pump 52 with a high pressure working fluid. Lines 28 and 30 pass through coupler 218. Production line 30 passes through couplers 212 and 218 and into inlet fitting 216 at the inlet end of the high pressure centrifugal pump stages.

The present invention has been described with reference to a preferred embodiment. The spirit and scope of the appended claims should not, however, necessarily be limited to the foregoing description.

What is claimed is:

1. A downhole petroleum pump comprising:

(a) a housing adapted for residence in a downhole location within a well;

(b) an electric motor within the housing;

(c) a plurality of centrifugal pump stages within the housing and driven by the motor, the centrifugal pump stages being serially coupled and having at least one low pressure stage and at least one high pressure stage to progressively increase the pressure of well fluid from a low value at the low pressure stage to a high value at the high pressure stage;

(d) means for providing the well fluid as the fluid to be pumped to the centrifugal pump stages;

(e) a jet pump within the housing having means for receiving an aspirated fluid and means for receiving a power fluid;

(f) means for providing high pressure well fluid to the jet pump from the high pressure centrifugal pump stage as the power fluid for the jet pump;

(g) means for providing well fluid to the jet pump at a pressure lower than the power fluid as the aspirated fluid to the jet pump;

(h) means for recirculating well fluid from the output of the jet pump, including the power fluid, to the high pressure centrifugal pump stage including the power fluid;

(i) means for drawing off well fluid from the high pressure centrifugal pump stage as the production fluid from the well; and (j) centrifugal cleaner means upstream of the jet pump for cleaning the power fluid of particulate matter, the cleaner means being powered by the electrical motor.

2. The pump claimed in claim 1 including booster centrifugal pump means powered by the electric motor between the cleaner means and the jet pump to increase the head of the power fluid.

3. The pump claimed in claim 2 wherein the means for providing well fluid as the aspirated fluid to the jet pump is operable to provide such fluid after it has had its head raised by the low pressure stage.

4. The pump claimed in claim 3 wherein the recirculation means is operable to the recirculate well fluid from the output of the jet pump to the inlet of the high pressure stage.

5. The pump claimed in claim 1 wherein the means for providing well fluid as the aspirated fluid to the jet pump is operable to provide such fluid after it has had its head raised by the low pressure stage.

6. The pump claimed in claim 5 wherein the recirculation means is operable to recirculate well fluid from the output of the jet pump to the inlet of the high pressure stage.

7. The pump claimed in claim 1 wherein the jet pump is removably stacked at an upper end of the pump for removing and changing the jet pump from a downhole location as required without removing the centrifugal pump stages and electric motor.

8. The pump claimed in claim 7 wherein the recirculation means is operable to recirculate well fluid from the output of the jet pump to the inlet of the high pressure stage.

9. The pump claimed in claim 8 wherein the means for providing well fluid as the aspirated fluid to the jet pump is operable to provide such fluid after it has had its head raised by the low pressure stage.

10. The pump claimed in claim 9 including booster centrifugal pump means powered by the electric motor between the cleaner means and the jet pump to increase the head of the power fluid.

11. For use in a pump powered by an electric motor and of the type used in petroleum wells at a downhole location for pumping as well fluid petroleum values from a petroleum bearing formation to the surface, the pump being of the type that has a sealed electrical motor at the downhole location and a plurality of serially coupled centrifugal pump stages powered by the electrical motor and progressing from at least one low pressure stage to at least one high pressure stage, an improvement comprising:

(a) a jet pump interstaged between the stages of the centrifugal pump and having an aspirated fluid inlet and a power fluid inlet;

(b) means to provide as an aspirated fluid to the jet pump aspirated fluid inlet well fluid from the low pressure centrifugal stages;

(c) means to provide as power fluid to the jet pump power fluid inlet well fluid from high pressure centrifugal pump stages;

(d) means for producing a production fluid stream from well fluid discharged from the high pressure centrifugal stages;

(e) means to supply as the input fluid to the high pressure centrifugal pump stages the output from the jet pump; and (f) centrifugal cleaner means between the outlet of the high pressure centrifugal pump stages and the power fluid inlet of the jet pump, the centrifugal cleaner means being powered by the electric motor.

12. The improvement claimed in claim 11 wherein the jet pump is removably stacked at an upper end of the pump for removing and changing the jet pump from a downhole location as required without removing the centrifugal pumps and electric motor.

13. The improvement claimed in claim 11 wherein the jet pump is included in an assembly that includes a sleeve, a nozzle assembly, a mixer throat and diffuser attached to the nozzle assembly for receiving the discharge of power fluid from the nozzle assembly, passage means from the nozzle assembly for the power fluid, and passage means between the nozzle assembly and mixer throat and diffuser for the aspirated fluid, the nozzle assembly and the mixer throat and diffuser being received in the sleeve for removal therefrom upon the application of a predetermined force thereon.

14. The improvement claimed in 13 wherein the nozzle assembly and the mixer throat and diffuser are slidably received in the sleeve for the removal therefrom upon the application of a predetermined pulling force thereon directed along the axis of the jet pump.

15. The improvement claimed in claim 14 including pulling tool means attached to the mixer throat and diffuser for the removal of the nozzle assembly and the mixer throat and diffuser, such tool means including latch means selectively locking the nozzle assembly, mixer throat and diffuser, and the tool to the balance of the pump, which latch means can be unlatched for the removal.

16. The improvement claimed in claim 15 wherein the sleeve provides a seat for the nozzle assembly and the mixer throat and diffuser for their location with respect to the balance of the pump, and wherein the passage means for the aspirated fluid includes radial passages in the sleeve and nozzle assembly registering upon the seating of the nozzle assembly and the mixer throat and diffuser.

17. The improvement claimed in claim 14 including booster pump means powered by the electric motor between the cleaner means and the jet pump to increase the head of the power fluid entering the power fluid inlet of the jet pump.

18. The improvement claimed in claim 17 including pulling tool means attached to the mixer throat and diffuser for the removal of the nozzle assembly and the mixer throat and diffuser, such tool means including latch means selectively locking the nozzle assembly, mixer throat and diffuser, and the tool to the balance of the pump, which latch means can be unlatched for the removal.

19. The improvement claimed in claim 18 wherein the sleeve provides a seat for the nozzle assembly and the mixer throat and diffuser for their location with respect to the balance of the pump, and wherein the passage means for the aspirated fluid includes radial passages in the sleeve and nozzle assembly registering upon the seating of the nozzle assembly and the mixer throat and diffuser.

* * * * *

UNITED STATES PATENT AND TRADEMARK OFFICE

CERTIFICATE OF CORRECTION

PATENT NO. : 4,294,573

DATED : Oct. 13, 1981

INVENTOR(S) : John W. Erickson
Harold L. Petrie

It is certified that error appears in the above—identified patent and that said Letters Patent is hereby corrected as shown below:

In the specification: Column 2, line 55, "putput" should be -- output --; Column 6, line 11, "nozle" should be -- nozzle --; Column 6, line 14, "difuser" should be -- diffuser --; Column 7, line 14, "49" should be -- 40 --; Column 7, line 15, "and"

In the claims: Claim 4, column 8, line 36, delete "the."

Signed and Sealed this

*Thirteenth* Day of *April 1982*

[SEAL]

*Attest:*

GERALD J. MOSSINGHOFF

*Attesting Officer*

*Commissioner of Patents and Trademarks*